US007255420B2

(12) United States Patent
Usuda

(10) Patent No.: US 7,255,420 B2
(45) Date of Patent: Aug. 14, 2007

(54) DROPLET JETTING APPARATUS, METHOD OF OPERATING DROPLET JETTING APPARATUS, AND DEVICE MANUFACTURING METHOD

(75) Inventor: Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 304 days.

(21) Appl. No.: 11/036,351

(22) Filed: Jan. 18, 2005

(65) Prior Publication Data

US 2005/0168517 A1 Aug. 4, 2005

(30) Foreign Application Priority Data

Jan. 30, 2004 (JP) ..... 2004-023872

(51) Int. Cl.
*B41J 2/165* (2006.01)
*B41J 2/015* (2006.01)

(52) U.S. Cl. ..... 347/29; 347/21; 347/30

(58) Field of Classification Search ..... 347/22, 347/28, 31, 29, 32, 23, 21
See application file for complete search history.

(56) References Cited

FOREIGN PATENT DOCUMENTS

JP A-2001-018408 1/2001
JP A 2001-138540 5/2001

*Primary Examiner*—Shih-Wen Hsieh
(74) *Attorney, Agent, or Firm*—Oliff & Berridge, PLC

(57) ABSTRACT

A droplet jetting apparatus having a droplet jetting head including a nozzle opening formed in a nozzle formation surface, from which droplets of a predetermined liquid are jetted, and a capping device for capping the nozzle opening of the head. A moisture retentive liquid supply device connected to the capping device is provided for supplying a moisture retentive liquid with respect to the predetermined liquid to a space formed by the nozzle formation surface and the capping portion. The weight and the size of the head and its periphery, which is a movable body, are not specifically increased, and accordingly, increase in the cost for motors for driving the droplet jetting head is prevented, thereby effectively avoiding clogging in the nozzle opening of the droplet jetting head. In addition, it is unnecessary to move the droplet jetting head when the moisture retentive liquid is supplied.

12 Claims, 6 Drawing Sheets

DROPLET JETTING APPARATUS, METHOD OF OPERATING DROPLET JETTING APPARATUS, AND DEVICE MANUFACTURING METHOD

BACKGROUND OF THE INVENTION

1. Field of the Invention

The present invention relates to a droplet jetting apparatus having a droplet jetting head in which a specific liquid is jetted as droplets from nozzle openings and a capping device for capping a nozzle opening of the droplet jetting head so as to prevent drying of the liquid or clogging of the nozzle opening, and also relates to a method of operating the droplet jetting apparatus and to a device manufacturing method.

Priority is claimed on Japanese Patent Application No. 2004-023872, filed Jan. 30, 2004, the content of which is incorporated herein by reference.

2. Description of Related Art

Generally, a droplet jetting head includes a pressure generating chamber for containing a specific liquid, a piezo actuator for compressing the pressure generating chamber, and a nozzle opening communicated with the pressure generating chamber. The liquid in the pressure generating chamber is compressed by the piezo actuator, thereby jetting a small amount of liquid from the nozzle opening as a droplet. In the droplet jetting head having the above structure, if liquid in the neighborhood of the nozzle opening is evaporated or if air bubbles remain inside the droplet-jetting head, a problem occurs in droplet jetting. Therefore, the above kind of droplet jetting head requires a capping device for capping or sealing the nozzle opening so as to prevent drying of the liquid or clogging of the nozzle opening.

The capping device includes a capping portion for capping the nozzle opening and an attraction pump for supplying negative pressure to the inside of the capping portion. The capping device not only caps the nozzle opening of the droplet jetting head by using the capping portion but also applies negative pressure to the capping portion by using the attraction pump so as to forcedly discharge the liquid from the nozzle opening, thereby discharging the liquid having increased viscosity in the neighborhood of the nozzle opening or air bubbles remaining in the pressure generating chamber.

Detailed descriptions about the conventional droplet jetting apparatus having the above-explained droplet jetting head and the capping device are found, for example, in Japanese Unexamined Patent Application, First Publication No. 2001-018408.

In the droplet jetting apparatus disclosed in the above document, an absorbent material is provided in the capping portion. When no printing is performed or the power source is off, a specific quantity of moisture retentive liquid is supplied in advance from a moisture retentive liquid tank to the absorbent material before capping of the nozzle opening, so as to reduce evaporation of the liquid from the nozzle opening after the capping, thereby maintaining the moist atmosphere in the capping portion.

However, droplets of the moisture retentive liquid drop from the moisture retentive liquid tank which is mounted on a carriage; thus, the size and the weight of the carriage is increased and increase in the cost for a carriage motor is unavoidable.

In addition, even when the nozzle opening of the droplet jetting head is capped using the capping device, if the capped state continues for a long period of time, increase in the viscosity of the liquid may occur due to decrease in moisture retention which is caused by evaporation of the liquid in a passage for the liquid or from a nozzle opening, or by drying in the capping device, so that the nozzle opening may be clogged. Accordingly, there is a demand to supply moisture retentive liquid to the capping portion at regular intervals after capping the nozzle opening, while maintaining the capped state of the nozzle opening.

As another method for clearing the clogging of the nozzle opening, other than the method of using a capping device, (i) a cleaning method is known, in which negative pressure is applied to a nozzle formation surface (i.e., a surface in which nozzle openings are formed) of the droplet jetting head so as to attract the liquid from the nozzle openings, and the nozzle forming plane is cleaned using a wiper after the attraction of the liquid, or (ii) a flushing method is known, in which the pressure applied to the pressure generating chamber by using the piezoelectric element is increased so as to forcedly jet droplets greater than a normal quantity of jetted droplets. However, in the above methods, the liquid is uselessly consumed and the life of the droplet jetting head or the wiper is reduced.

SUMMARY OF THE INVENTION

In consideration of the above circumstances, an object of the present invention is to provide (i) a droplet jetting apparatus in which moisture retentive liquid can be supplied to a capping portion while maintaining the sealed state of the nozzle opening of the droplet jetting head by using a capping device, thereby effectively avoiding clogging in the nozzle opening or the like, and preventing useless consumption of the liquid or decrease in life of the droplet jetting head and the wiper, (ii) a method of operating the droplet jetting apparatus, and (iii) a device manufacturing method.

Therefore, the present invention provides a droplet jetting apparatus having a droplet jetting head which includes a nozzle opening from which droplets of a predetermined liquid are jetted and which is formed in a nozzle formation surface, and a capping device for capping at least the nozzle opening of the droplet jetting head, the apparatus comprising:

a moisture retentive liquid supply device for supplying a moisture retentive liquid with respect to the predetermined liquid to a space formed by the nozzle formation surface and the capping portion, wherein the moisture retentive liquid supply device is connected to the capping device.

According to the above apparatus, the supply of the moisture retentive liquid to the inside of the space formed by the nozzle formation surface and the capping device is performed by the moisture retentive liquid supply device which is connected to the capping device; thus, the weight and the size of the droplet jetting head and its periphery (which is a movable body) are not specifically increased, and accordingly, increase in the cost for motors for driving the droplet jetting head is prevented, thereby effectively avoiding clogging in the nozzle opening of the droplet jetting head. In addition, it is unnecessary to move the droplet jetting head when the moisture retentive liquid is supplied.

Typically, the moisture retentive liquid is supplied from a side opposite to a side where the droplet jetting head is provided, with respect to an absorbent material provided in the capping device.

In this case, the moisture retentive liquid can be supplied without separating the capping device from the droplet jetting head, that is, while maintaining the capped state of the nozzle opening. Therefore, even if the period of time in which the nozzle opening is capped is long, the moisture retentive liquid can be, supplied at regular intervals while maintaining the capped state, thereby reducing the number of times of cleaning. Therefore, it is possible to lengthen life of the wiper provided in a cleaning unit for executing the cleaning.

The droplet jetting apparatus may further comprise:

a counting device for counting a period of time while the nozzle opening is capped by the capping device; and a control device for controlling supply timing of the moisture retentive liquid into the space according to the kind of the moisture retentive liquid.

According to this structure, the kind of the moisture retentive liquid is considered in a determination process performed after printing. Therefore, according to the degree of dryness which varies depending on the moisture retentive liquid, the quantity or the time interval (for the supply operation) of the supplied moisture retentive liquid can be appropriately controlled, thereby reducing useless consumption of the moisture retentive liquid as much as possible and effectively avoiding clogging of the nozzle opening, or the like.

The present invention also provides a method of operating a droplet jetting apparatus which includes a droplet jetting head which includes a nozzle opening from which droplets of a predetermined liquid are jetted and which is formed in a nozzle formation surface, a capping device for capping at least the nozzle opening of the droplet jetting head, and a moisture retentive liquid supply device for supplying a moisture retentive liquid with respect to the predetermined liquid to a space formed by the nozzle formation surface and the capping portion, the method comprising the step of:

supplying the moisture retentive liquid into the space after the nozzle opening is capped by the capping device.

In this case, the moisture retentive liquid can be supplied without separating the capping device from the droplet jetting head, that is, while maintaining the capped state of the nozzle opening. Therefore, it is unnecessary to move the droplet jetting head when the moisture retentive liquid is supplied. In addition, even if the period of time in which the nozzle opening is capped is long, the moisture retentive liquid can be supplied at regular intervals while maintaining the capped state, thereby reducing the number of times of cleaning. Therefore, it is possible to lengthen life of the wiper provided in a cleaning unit for executing the cleaning.

The present invention also provides a device manufacturing method for manufacturing a device which includes a work on which a functional pattern is formed in a predetermined area, the method comprising:

a pattern forming step performed using a droplet jetting head provided in the droplet jetting apparatus as claimed in any one of claims 1 to 4 or using a droplet jetting head used in the method as claimed in claim 5, wherein the step includes forming the pattern on the work by jetting droplets of the predetermined liquid by using the droplet jetting head; and a step of supplying the moisture retentive liquid into the space after the nozzle opening is capped by the capping device.

In this case, a pattern is formed by jetting the predetermined liquid as droplets, and then the nozzle opening is capped by the capping device. After that, the moisture retentive liquid can be supplied without separating the capping device from the droplet jetting head; thus, it is unnecessary to move the droplet jetting head when the moisture retentive liquid is supplied. Accordingly, devices can be efficiently manufactured without reducing the throughput, thereby reducing the manufacturing cost for devices.

DETAILED DESCRIPTION OF THE INVENTION

Hereinafter, the droplet jetting apparatus, the method of operating the droplet jetting apparatus, and the device manufacturing method, as embodiments according to the present invention, will be explained in detail with reference to the drawings.

Droplet Jetting Apparatus

Figure 1:
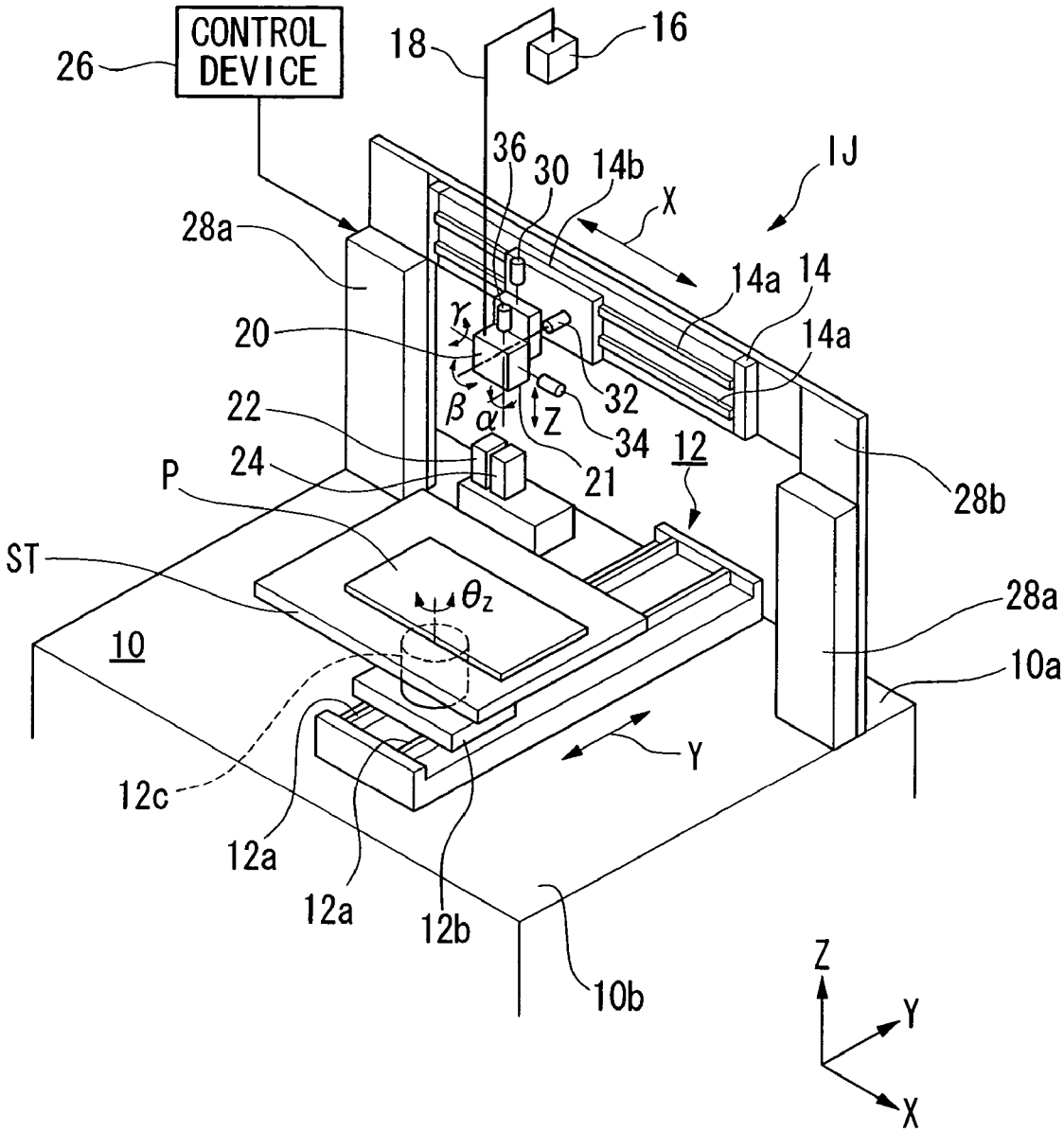
FIG. 1 is a perspective view showing the general structure of the droplet jetting apparatus as an embodiment of the present invention.

FIG. 1 is a perspective view showing the general structure of the droplet jetting apparatus as an embodiment of the present invention. In the following explanation, the XYZ orthogonal coordinate system is provided in the drawings where necessary, and the positional relationships between members are explained with reference to the XYZ orthogonal coordinate system. In the XYZ orthogonal coordinate system, the XY plane is defined as a plane parallel to the horizontal plane and the Z axis is defined in the upward vertical direction. In the present embodiment, the moving direction (i.e., the main scanning direction) of the jet head (i.e., droplet jetting head) 20 is defined as the X direction, and the moving direction (i.e., the sub scanning direction) of the stage ST is defined as the Y direction.

As shown in FIG. 1, the droplet jetting apparatus IJ of the present embodiment has a base 10, a stage ST for supporting a substrate P, such as a glass substrate, on the base 10, and a jet head 20 which can jet specific droplets towards the substrate P. Between the base 10 and the stage ST, a first moving device 12 is provided for supporting the stage ST in a manner such that the stage ST can move in the Y direction. Above the stage ST, a second moving device 14 is provided for supporting the jet head 20 in a manner such that the jet head 20 can move in the X direction.

A tank 16 is connected via a passage 18 to the jet head 20. The tank 16 contains liquid (i.e., a predetermined liquid) which are jetted from the jet head 20. On the base 10, a capping unit 22 (i.e., a capping device) and a cleaning unit 24 are provided. The control device 26 controls each portion of the droplet jetting apparatus IJ (e.g., the first moving device 12, the second moving device 14, and the like), thereby controlling the entire operation of the droplet jetting apparatus IJ.

The first moving device 12 is provided on the base 10 and the position of this moving device is determined along the Y axis. This first moving device 12, which may be realized using a linear motor, has guide rails 12*a* and 12*a*, and a slider 12*b* which can be moved along the guide rails 12*a* and 12*a*. The slider 12*b* of the first moving device 12 which employs a linear motor function can be positioned while moving in the Y direction along the guide rails 12*a* and 12*a*.

The slider 12*b* has a motor 12*c* for the action around the Z axis (i.e., θz). The motor 12*c* may be a direct drive motor, and the rotor of the motor is fixed to the stage ST. Accordingly, when the motor 12*c* is energized, the rotor and the stage ST rotate along the θz direction so that the stage ST can be indexed, that is, the quantity of rotation can be determined. Therefore, the first moving device 12 can move the stage ST in the Y axis and θz directions. The stage ST holds the substrate P and positions the substrate at a specific position. The stage St also has an attracting and holding device (not shown). When the attracting and holding device is activated, the substrate P is attracted and fastened to the stage ST via attraction holes (not shown) provided in the stage ST.

The second moving device 14 is attached to the base 10 via supports 28*a* and 28*a* in a manner such that the second moving device 14 stands on the rear portion 10*a* of the base 10. The second moving device 14 has a linear motor and is supported by the columns 28*b* fastened to the supports 28*a* and 28*a*. The second moving device 14 also has guide rails 14*a* and 14*a* supported by the columns 28*b* and a slider 14*b* which is supported in a manner such that the slider can move in the X direction along the guide rails 14*a* and 14*a* so as to position the slider. The above jet head 20 is attached to the slider 14*b*.

The jet head 20 includes a motor 30 for determining the position in the Z direction, and motors 32, 34, and 36 which function as a reciprocating positioning device. The jet head 20 can be moved upward and downward in the Z direction by driving the motor 30 and can be positioned at any position in the Z direction. The jet head 20 can be reciprocated along the β direction around the Y axis by driving the motor 32, thereby adjusting the angle of the jet head 20. The jet head 20 can be reciprocated along the γ direction around the X axis by driving the motor 34, thereby also adjusting the angle of the jet head 20. The jet head 20 can be reciprocated along the α direction around the Z axis by driving the motor 36, thereby also adjusting the angle of the jet head 20.

As explained above, the jet head 20 in FIG. 1 is supported by the slider 14*b* in a manner such that the head can be linearly moved in the Z direction and the angle of the head can be adjusted by reciprocating the head along the α, β, and γ directions. The position and orientation of the jet head 20 are accurately controlled by the control device 26 so that the droplet jet surface 21 with respect to the substrate P on the stage ST has a predetermined position or orientation. In the droplet jet surface 21 (i.e., the nozzle formation surface) of the jet head 20, a plurality of nozzle openings 111 are provided for jetting droplets.

The droplets jetted from the jet head 20 may be droplets which include a material selected from various kinds of material such as (i) ink which includes coloring material, (ii) dispersion liquid which includes dispersed materials such as metal particles, (iii), solution which includes an organic EL material such as material used for hole injection (e.g., oly(3,4-ethylenedioxythiophene) (PEDOT): poly(styrene sulfonate) (PSS)), or luminescent material, (iv) functional liquid having high viscosity such as liquid crystal material, (v) functional liquid including material for micro lenses, and (vi) biopolymer solution including protein, nucleic acid, or the like.

Figure 2:
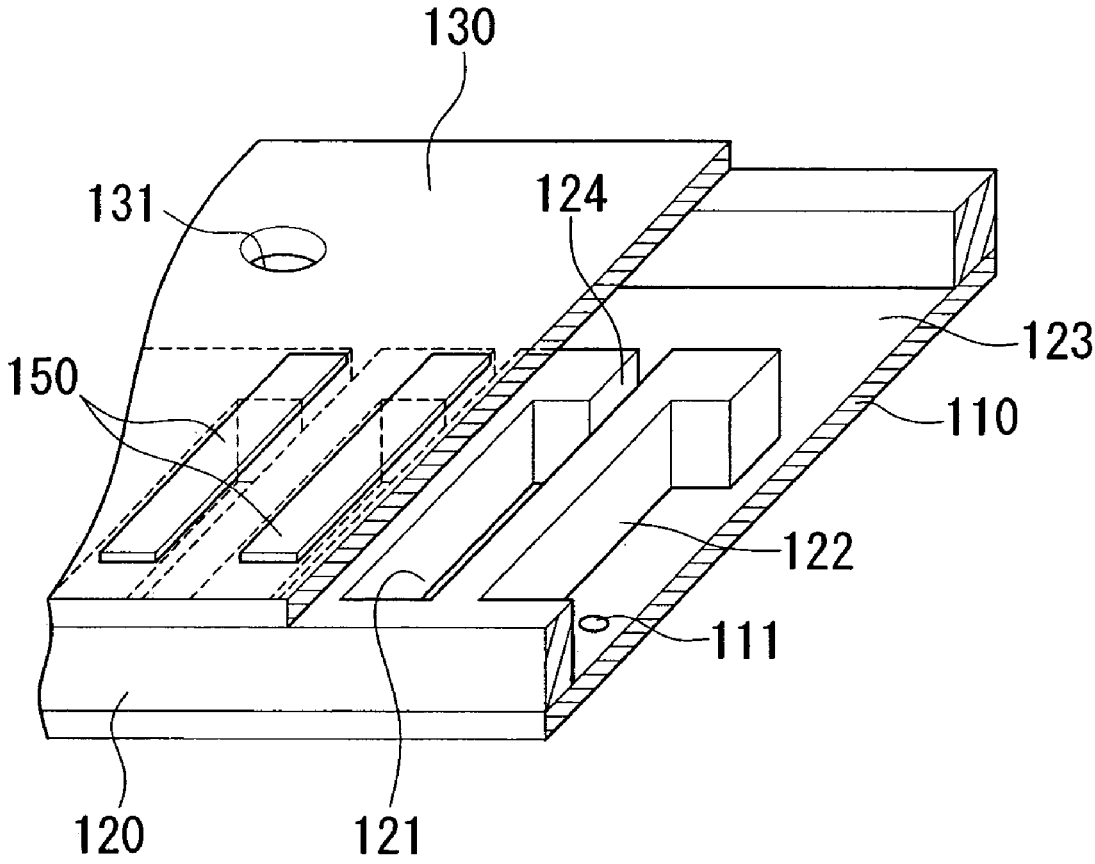
FIG. 2 is a perspective view showing a main portion of the jet head.

The structure of the jet head 20 will be explained below. FIG. 2 is a perspective view showing a part of the main component of the jet head 20. The jet head 20 shown in FIG. 2 includes a nozzle plate 110, a pressure chamber substrate 120, and a diaphragm 130. The pressure chamber substrate 120 has cavities 121 as pressure generating chambers, side walls 122, a reservoir 123, and supply inlets 124. The cavities 121 are pressure chambers formed by performing etching of a substrate made of silicon or the like. The side walls 122 are formed as partitions between the cavities 121. The reservoir 123 is formed as a common passage for supplying a predetermined liquid, which is used when the predetermined liquid is supplied to each cavity 121. The predetermined liquid can be drawn into each cavity through the supply inlets 124.

The diaphragm 130 can be adhered to a face of the pressure chamber substrate 120. Piezoelectric elements 150, which are elements of the piezoelectric device, are provided on the diaphragm 130. The piezoelectric element 150 is a ferroelectric crystal having the perovskite structure and is formed as a specific shape on the diaphragm 130. The volume of the piezoelectric element 150 can be changed in accordance with a driving signal supplied from the control device 26.

The nozzle plate 110 is adhered to the pressure chamber substrate 120 in a manner such that the aligned nozzle openings 111 are respectively positioned to the aligned cavities 121 (i.e., pressure chambers). The pressure chamber substrate 120, to which the nozzle plate 110 is adhered, is contained in a body (not shown) for forming the jet head 20.

In order to jet droplets from the jet head 20, first, the control device 26 supplies a driving signal for jetting a droplet to the jet head 20. Here, the predetermined liquid has been drawn into cavities 121 of the jet head 20; thus, when the driving signal is supplied to the jet head 20, the volume of the piezoelectric element 150 provided at the jet head 20 changes in accordance with the driving signal. This volume change deforms the diaphragm 130 and changes the volume of the cavity 121. Accordingly, a droplet is jetted from the nozzle opening 111 of the cavity 121. A new droplet is supplied from the tank 16 to the cavity 121 from which the droplet was jetted.

The jet head 20 explained with reference to FIG. 2 has a structure for jetting a droplet by producing changes in volume by using the piezoelectric element. However, the head may have a structure including a heating device for heating the predetermined liquid so as to jet the droplets due to expansion of the liquid, or changes in volume may be produced by deformation of the diaphragm caused by static electricity, so as to jet droplets.

Again referring to FIG. 1, the second moving device 14 can selectively position the jet head 20 above the cleaning unit 24 or the capping unit 22 by moving the jet head 20 in the X direction. That is, even in the middle of the device manufacturing process, if the jet head 20 is moved above the cleaning unit 24, cleaning of the jet head 20 can be performed. If the jet head 20 is moved above the capping unit 22, it is possible to perform (i) capping of the droplet jet surface 21 of the jet head 20, (ii) filling of the cavities 121 with droplets, (iii) retrieval of substandard jetting due to clogging of the nozzle openings 111, or the like.

That is, the cleaning unit 24 and the capping unit 22 are positioned at the rear portion 10*a* of the base 10 and immediately under the path of the movement of the jet head 20, where the units 24 and 22 are isolated from the stage ST. The carrying-in and carrying-out operations of the substrate P to and from the stage ST are performed at the front portion 10*b* of the base 10; thus, the carrying-in and carrying-out operations are not disturbed by the cleaning unit 24 and the capping unit 22.

The cleaning unit 24 has a wiper for wiping the surface in which the nozzle openings 111 are formed, thereby performing the cleaning of the nozzle openings 111 or the like of the jet head 20 regularly or optionally during the device manufacturing process or in the stand-by state. In order to protect the droplet jet surface 21 of the jet head 20 from drying, the capping unit 22 performs capping of the droplet jet surface 21 in the stand-by state in which devices are not manufactured. The capping unit 22 is also used when filling the cavities 121 with droplets, or when retrieving the jet head 20 which caused substandard jetting.

Capping Unit

Figure 3:
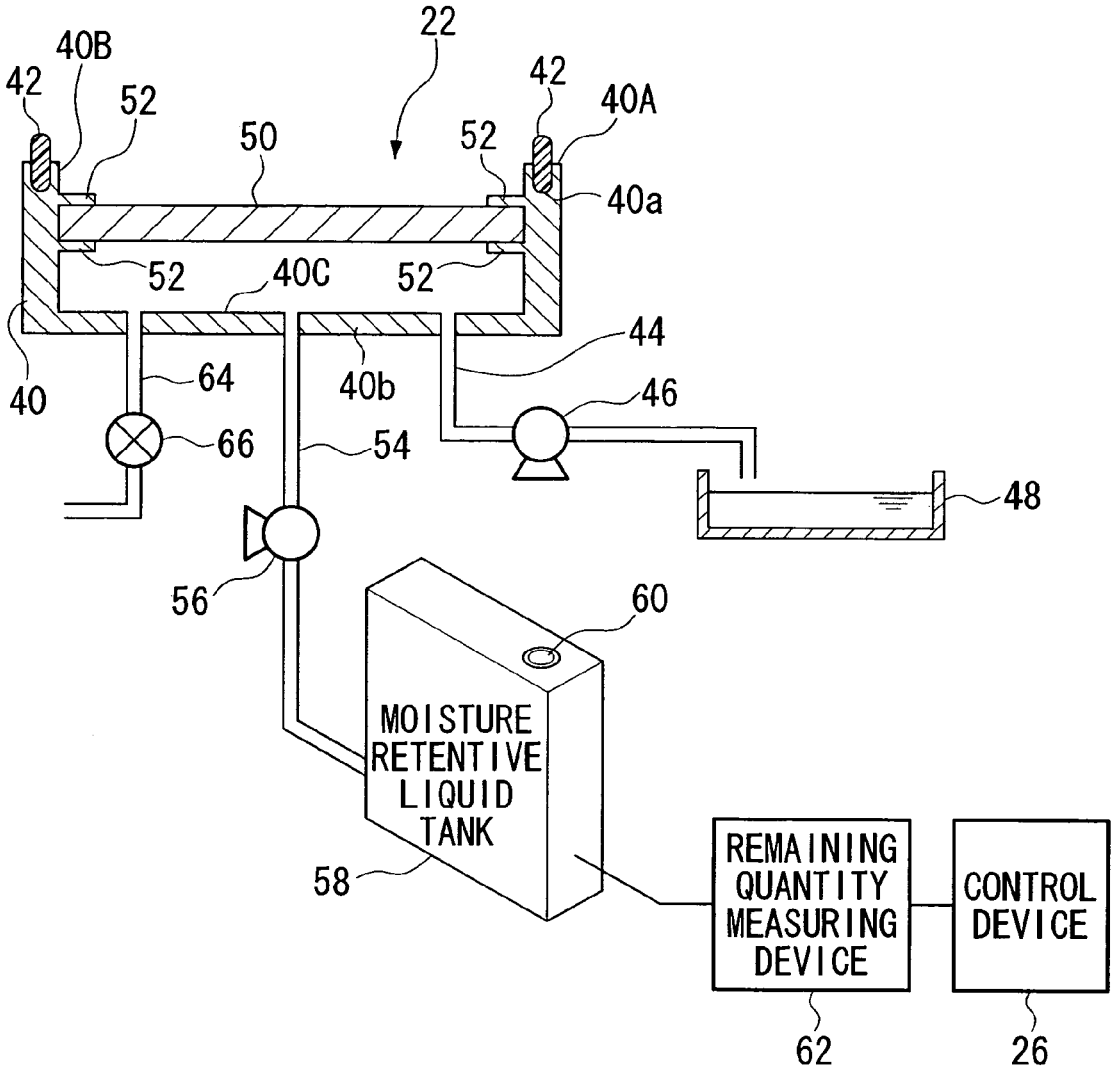
FIG. 3 is a diagram showing the structure of the capping unit.

The capping unit 22 will be explained in detail. FIG. 3 is a diagram showing the structure of the capping unit 22. As shown in FIG. 3, the capping unit 22 includes a box-shaped capping main body 40 (i.e., a capping portion), a seal member 42 which contacts the nozzle formation surface (i.e., the droplet jet surface 21), a first communication tube 44, a first pump 46, an absorbent material 50, a second communication tube 54, a second pump 56, a third communication tube 64, and an atmosphere open valve 66.

In an end face 40A at the sealed side of the capping main body 40, a concave groove 40*a* is formed along the entire circumference of the end face. In the concave groove 40*a*, the seal member 42, which has a square shape and is made of a flexible material such as a rubber, is inserted in a manner such that a part of the seal member protrudes from the end face 40A.

In the inner-peripheral face 40B of the capping main body 40, a pair of fitting portions 52, protruding towards the inside of the capping main body 40, are provided. A peripheral edge of the absorbent material 50 is held by the fitting portions 52, so that the absorbent material 50 is fixed at a position away by a specific distance from the inner bottom face 40C of the capping main body 40. The absorbent material 50 has superior absorption for the droplets jetted from the jet head 20 and maintains the wet state after the droplets are absorbed. The absorbent material 50 may be a sponge material having continuous micro pores.

The first, second, and third communication tubes 44, 54, and 64 are connected to the bottom portion 40*b* of the capping main body 40 in a manner such that each communication tube passes through the bottom portion 40*b* and is open in the inner bottom face 40C.

To the first communication tube 44, the first pump 46 is connected, which is provided for drawing the air in the capping main body 40, that is, in a space formed by the nozzle formation surface of the jet head 20 and the capping main body 40 so as to reduce the pressure in the space (or supply negative pressure to the space). At the discharge side of the first pump 46, a drain tank 48 is provided, in which drained material accompanied with cleaning operation or the like is pooled. The first pump 46 is electrically connected to the control device 26 (refer to FIG. 4) and is driven under the control of the control device 26.

To the second communication tube 54, a moisture retentive liquid tank 58 having an atmosphere drawing inlet 60 is connected via the second pump 56. The moist state of the absorbent material 50 is maintained in a long period of time by supplying moisture retentive liquid from the moisture retentive liquid tank 58 to the inside of the capping main body 40. The moisture retentive liquid tank 58 is provided on the base 10, and a remaining quantity measuring device 62 for measuring the remaining quantity of the moisture retentive liquid is connected to the tank 58. Only when the remaining quantity of the moisture retentive liquid becomes equal to or less than a predetermined value, the remaining quantity measuring device 62 may output data which indicates that state. For example, a float member may be provided in the moisture retentive liquid tank 58 and the remaining quantity measuring device 62 may determine that the remaining quantity of the moisture retentive liquid becomes equal to or less than a predetermined value, by referring to the position of the float member, and output a signal indicating that state.

The second pump 56 and the remaining quantity measuring device 62 are electrically connected to the control device 26 (refer to FIG. 4) and are driven under the control of the control device 26 based on the remaining quantity of the moisture retentive liquid measured by the remaining quantity measuring device 62.

To the third communication tube 64, the atmosphere open valve 66 is connected for making the inside of the capping main body 40 communicate with the outside of the capping main body 40 via the third communication tube 64. The atmosphere open valve 66 is electrically connected to the control device 26 (refer to FIG. 4) and is driven under the control of the control device 26.

As explained above, in the present embodiment, the second communication tube 54, the second pump 56, the moisture retentive liquid tank 58, the remaining quantity measuring device 62, and the control device 26 construct the moisture retentive liquid supply device of the present invention.

Figure 4:
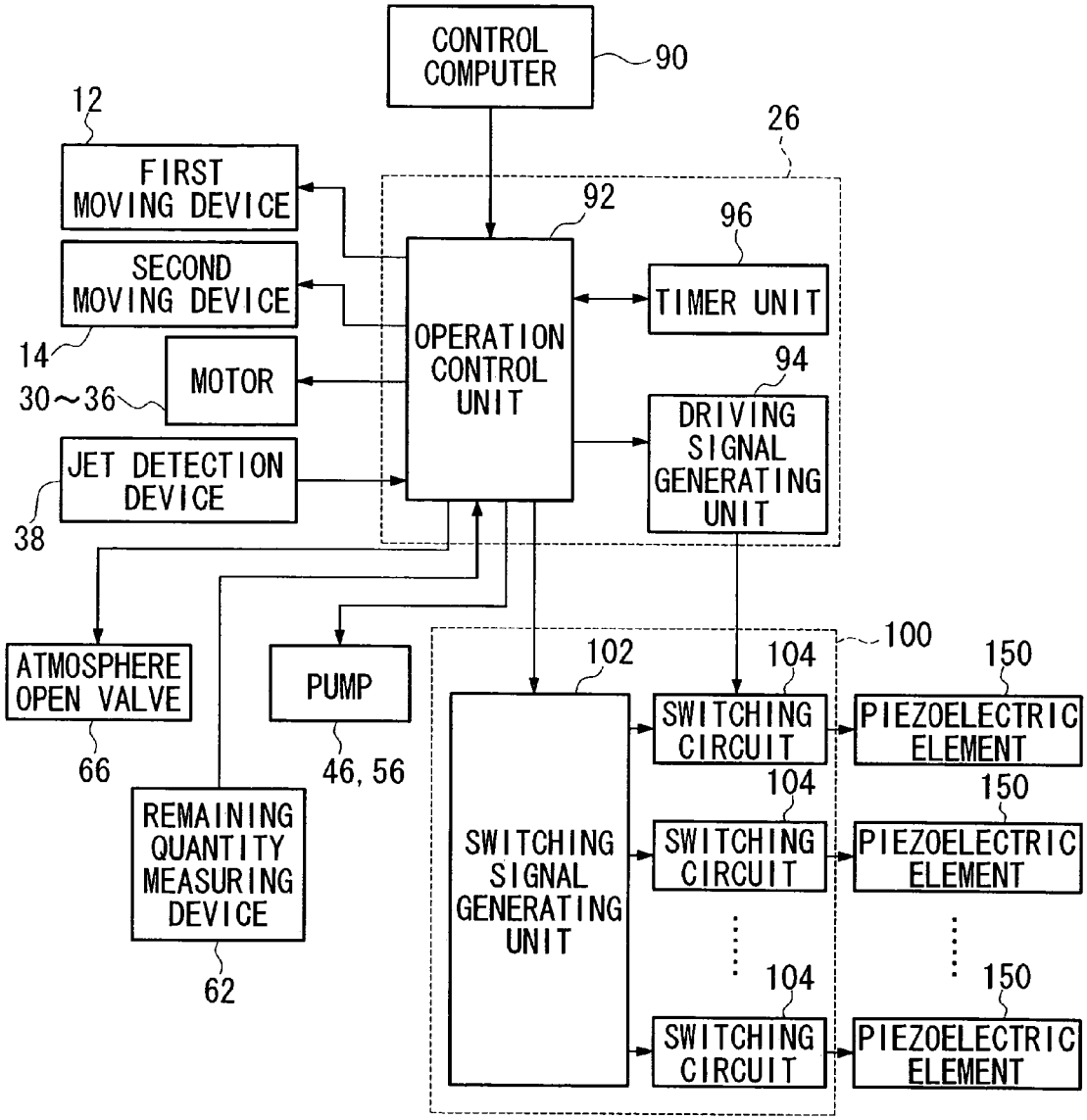
FIG. 4 is a block diagram for showing the electrical function and structure of the droplet jetting apparatus in the embodiment.

The electrical function and structure of the droplet jetting apparatus IJ of the present embodiment will be explained below. In a block diagram of FIG. 4, blocks corresponding to the members shown in FIGS. 1 to 3 are given identical reference numerals. As shown in FIG. 4, the electrical structure for controlling the droplet jetting apparatus IJ includes a control computer 90, the control device 26, and a driving integrated circuit 100.

The control computer 90 may include a CPU (central processing unit), internal storage devices such as a RAM (random access memory) and a ROM (read only memory), external storage devices such as a hard disk and a CD-ROM, and a display device such as a liquid crystal display, a CRT (cathode ray tube), or the like. According to the program stored in the ROM or the hard disk, the control computer 90 outputs control signals for controlling the droplet jetting apparatus IJ. This control computer 90 is connected to the control device 26 via, for example, a cable.

The control device 26 includes an operation control unit 92, a driving signal generating unit 94, and a timer unit 96 (i.e., a counting device). The operation control unit 92 drives the first moving device 12, the second moving device 14, and the motors 30 to 36 and also controls the operations of the pumps 46 and 56, the remaining quantity measuring device 62, and the atmosphere open valve 66 provided in the capping unit 22, based on the control signals input from the control computer 90 and the control program which is stored in the operation control unit 92 in advance.

The operation control unit 92 also outputs to the driving signal generating unit 94, various data (i.e., driving signal generating data) for generating driving signals for driving the piezoelectric elements 150, which are provided in the jet head 20. The operation control unit 92 also generates selection data based on the above control program and outputs the data to a switching signal generating unit 102 which is provided in the driving integrated circuit 100. This selection data consists of nozzle selection data for designating a piezoelectric element 150 to which the driving signal is applied, and waveform selection data for designating a driving signal to be applied to the piezoelectric element 150.

The operation control unit 92 also counts the time while the nozzle opening is capped using the capping unit 22, that is, the time while the jet head 20 is capped or sealed by the capping main body 40, by using the timer unit 96, and controls the quantity and the timing of the moisture retentive liquid supplied from the moisture retentive liquid tank 58 to the above-explained space, according to the counted result, the kind of the moisture retentive liquid, whether cleaning operation of the jet head 20 was performed after opening the capped portion, or the like. Here, when the remaining quantity of the moisture retentive liquid in the moisture retentive liquid tank 58 becomes equal to or less than a predetermined value, a signal indicating that state is output from the remaining quantity measuring device 62 to the control device 26, so that, for example, an error message is shown in a display device of the control computer 90.

Based on the driving signal generating data, the driving signal generating unit 94 generates various kinds of driving signals which have specific forms, and outputs the generated signals to the switching circuit 104, which may be a normal driving signal for jetting droplets and a micro-reciprocating signal for producing micro-reciprocation of a meniscus portion at the nozzle opening 111. To the timer unit 96, a counting start signal and counting time output from the operation control unit 92 are input, and the timer unit 96 outputs a counting complete signal when the counting time has eplapsed after the start of counting.

The driving integrated circuit 100, provided in the jet head 20, includes the switching signal generating unit 102 and the switching circuit 104. The switching signal generating unit 102 generates a switching signal for designating conduction or non-conduction of the driving signal to each piezoelectric element 150 based on the selection data output from the operation control unit 92, and outputs the generated signal to the switching circuit 104. The switching circuit 104 is provided for each piezoelectric element 150 and outputs a driving signal designated by the switching signal to the piezoelectric element 150.

Next, the method of operating the droplet jetting apparatus IJ having the above structure, performed after a microarray is formed on the substrate P by using the droplet jetting apparatus IJ, will be explained in detail.

Figure 6:
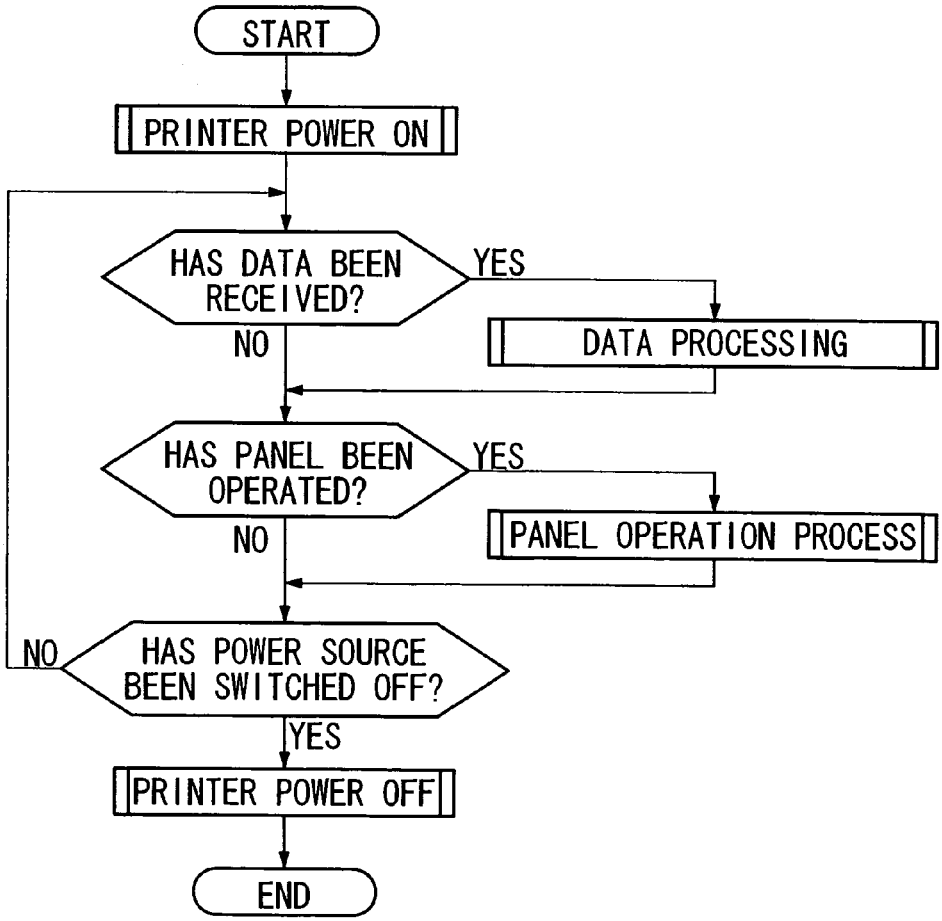
FIG. 6 is a flowchart showing the entire process from on to off of the power switch.

The last step in the flowchart shown in FIG. 6, that is, the "printer power off" step, is performed when the power source switch is switched off by an operator or power is disconnected due to pulling of the plug of the printer from a wall outlet, power failure, or the like. The method of operating the droplet jetting apparatus IJ is performed in the flushing process which is executed in the "printer power off" step.

Figure 7:
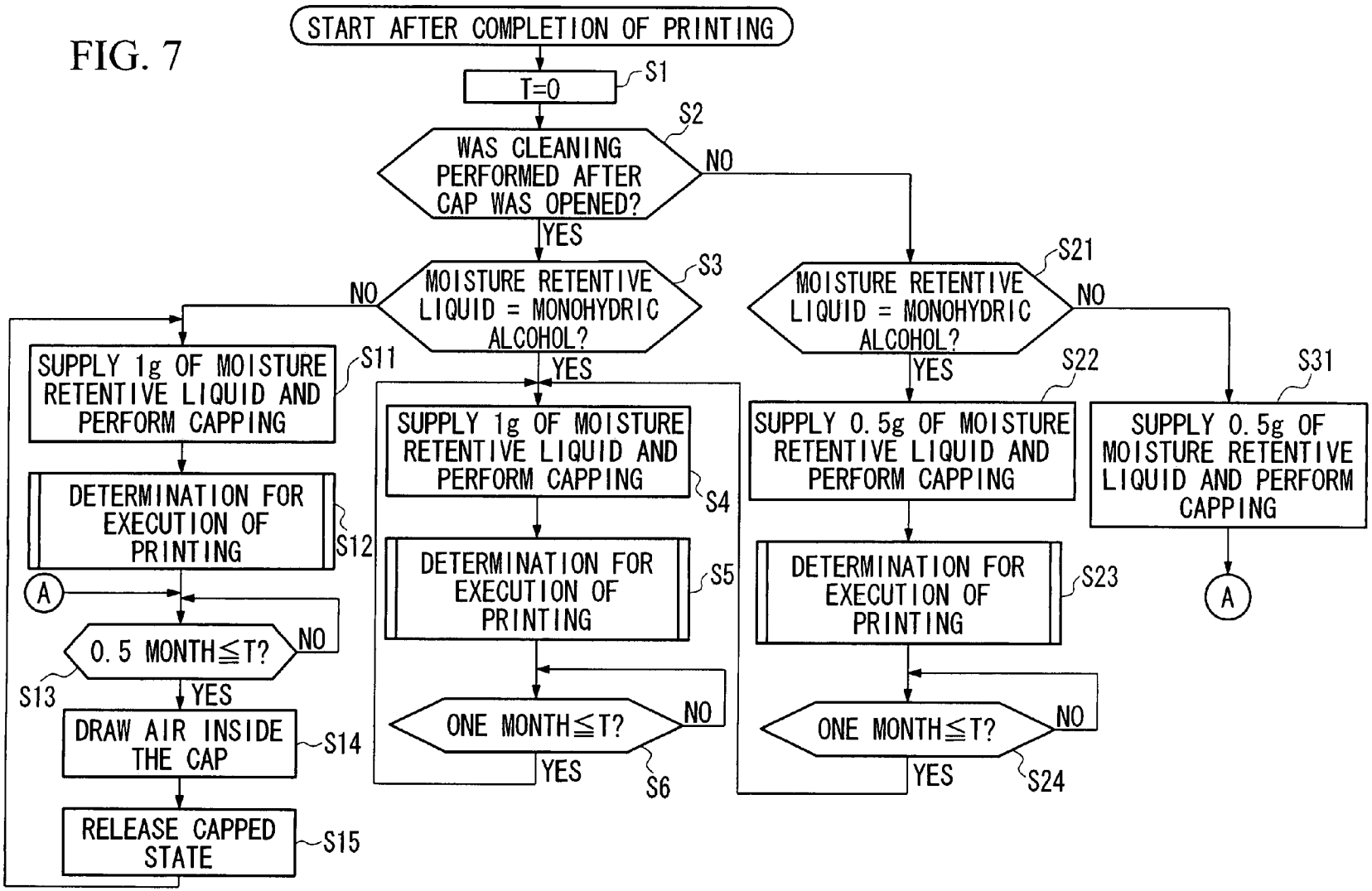
FIG. 7 is a flowchart showing concrete steps of the capping operation.

In step S1 of the flowchart in FIG. 7, the nozzle opening capping period T of time, counted by the timer unit 96, is reset, that is, set to zero, and the counting of the nozzle opening capping period T is started. The reset and counting start of the nozzle opening capping period T are performed immediately before the nozzle opening 111 is capped by the capping main body 40 after completion of printing (hereinbelow, the above capping operation is called capping).

In the next step S2, it is determined whether cleaning was performed after the cap was opened last time, that is, the capped state using the capping main body 40 was released. This is because the quantity remaining in the absorbent material 50 varies according to whether cleaning operation was performed after cap opening, and thus the quantity of moisture retentive liquid to be supplied to the capping main body 40 should also be changed.

If cleaning was performed after cap opening (i.e., YES in determination of step S2), the operation proceeds to step S3, where it is determined whether the moisture retentive liquid includes monohydric alcohol. This is because the time interval for supplying the moisture retentive liquid to the capping main body 40 and necessity of suction for inside of the capping main body (regarding step S14 explained below) are determined depending on whether the moisture retentive liquid includes monohydric alcohol or polyhydric alcohol.

If the moisture retentive liquid includes monohydric alcohol (i.e., YES in determination of step S3), the operation proceeds to step S4, where 1 g (gram) of moisture retentive liquid is supplied to the capping main body 40 from the lower side of the absorbent material 50, and after that, capping is performed.

In the next step S5, it is determined whether there is a printing execution command issued by an operator. If there is no printing execution command, the operation proceeds to step S6, while if there is a printing execution command, the operation (of the operation sequence in FIG. 5) returns to the main operation sequence.

In step S6, it is determined whether the nozzle opening capping period T, whose counting was started in step S1, is one month or longer. If one month has already elapsed (i.e., YES in the determination), the operation returns to step S4, where 1 g of the moisture retentive liquid is again supplied to the capping main body 40. Conversely, if one month has not yet elapsed (i.e., NO in the determination), the determination of step S6 is repeatedly performed.

In step S3, when the moisture retentive liquid includes polyhydric alcohol (i.e., YES in the determination), the operation proceeds to step S11, where 1 g of the moisture retentive liquid is supplied to the capping main body 40 from the lower side of the absorbent material 50, and after that, capping is performed.

In the next step S12, it is determined whether there is a printing execution command issued by an operator. If there is no printing execution command, the operation proceeds to step S13, while if there is the printing execution command, the operation returns to the process from which the present operation sequence is called.

In step S13, it is determined whether the nozzle opening capping period T, whose counting was started in step S1, is 0.5 month or longer. If 0.5 month has already elapsed (i.e., YES in the determination), the operation proceeds to step S14, where suction for inside of the capping main body 40 is performed by driving the first pump 46 and drawing air from the inside of the capping main body 40 via the first communication tube 44 (i.e., reducing the pressure in the capping main body 40 or supplying negative pressure to the capping main body 40), so as to prevent clogging in the nozzle opening 111. After that, the capped state of the nozzle opening 111 using the capping main body 40 is released (see step S15) and the operation returns to step S11, where 1 g of the moisture retentive liquid is again supplied to the capping main body 40.

Conversely, if 0.5 month has not yet elapsed (i.e., NO in the determination of step S13), the determination of step S13 is repeatedly performed.

The reason for the difference between the process from step S11 to S15 and the process from step S4 to S6 is that if the moisture retentive liquid includes polyhydric alcohol, when a specific period of time has elapsed after supplying the moisture retentive liquid to the capping main body 40, the moisture retentive liquid absorbs moisture contents in the jet head 20 from the nozzle opening 111; thus, it is preferable to use a relatively shorter time interval for replenishing the moisture retentive liquid (see steps S6 and S13) and to perform the suction step of the inside of the cap (see step S14).

If cleaning was not performed after cap opening (i.e., NO in the determination of step S2), the operation proceeds to step S21, where it is determined whether the moisture retentive liquid includes monohydric alcohol. This is because the time interval for supplying the moisture retentive liquid to the capping main body 40 and necessity of drawing from inside of the cap (regarding step S14) are determined depending on whether the moisture retentive liquid includes monohydric alcohol or polyhydric alcohol.

If the moisture retentive liquid includes monohydric alcohol (i.e., YES in determination of step S21), the operation proceeds to step S22, where 0.5 g of moisture retentive liquid is supplied to the capping main body 40 from the lower side of the absorbent material 50, and after that, capping is performed. In this process, the quantity of the supplied moisture retentive liquid is less than 1 g employed in steps S4 and S7. This is because in comparison with the case in which cleaning was performed after cap opening, more moisture retentive liquid remains in the capping main body 40.

In the next step S23, it is determined whether there is the printing execution command issued by an operator. If there is no printing execution command, the operation proceeds to step S24, while if there is the printing execution command, the operation returns to the process from which the present operation sequence is called.

In step S24, it is determined whether the nozzle opening capping period T, whose counting was started in step S1, is one month or longer. If one month has already elapsed (i.e., YES in the determination), the operation proceeds to step S4, where 1 g of the moisture retentive liquid is again supplied to the capping main body 40. Conversely, if one month has not yet elapsed (i.e., NO in the determination), the determination of step S24 is repeatedly performed.

In step S21, when the moisture retentive liquid includes polyhydric alcohol (i.e., NO in the determination), the operation proceeds to step S31, where 0.5 g of the moisture retentive liquid is supplied to the capping main body 40 from the lower side of the absorbent material 50, and after that, capping is performed. The operation then proceeds to the above-explained step S13.

If cleaning was not performed after cap opening (i.e., NO in the determination of step S2), 0.5 g of the moisture retentive liquid is sufficient as the quantity supplied to the capping main body 40 for the first time. However, the moisture retentive liquid is next supplied when 0.5 month or more, or one month or more has elapsed after the first supply; thus, the quantity of the supplied moisture retentive liquid is set to 1 g which is the same as that in the case in which cleaning was performed after cap opening (i.e., YES in the determination of step S2).

As explained above, in the present embodiment, the supply of the moisture retentive liquid to the inside of the space which is formed by the nozzle formation surface and the capping main body 40 is performed from the moisture retentive liquid tank 58 and via the second communication tube 54 and the bottom portion 40*b* of the capping main body 40. Therefore, the weight and the size of the jet head 20 and its periphery (which is a movable body) are not specifically increased, and accordingly, increase in the cost for the motors 30, 32, 34, and 36 as driving sources is prevented, thereby effectively avoiding clogging in the nozzle opening 111 of the jet head 20.

In addition, the moisture retentive liquid is supplied from a lower side of the absorbent material 50 (i.e., not from the side where the jet head 20 is provided); thus, it is unnecessary to detach the capping unit 22 from the jet head 20 every time the moisture retentive liquid is supplied. That is, the supply of the moisture retentive liquid can be performed while capping the nozzle opening 111, and thus movement of the jet head 20 can be omitted when the moisture retentive liquid is supplied. Additionally, even if the period of time in which the nozzle opening is capped is long, the moisture retentive liquid is supplied at regular intervals while maintaining the capped state, thereby reducing the number of times of cleaning. Therefore, it is possible to lengthen life of the wiper provided in the cleaning unit 24.

In the flushing operation performed after the completion of printing, it is determined whether cleaning was performed after cap opening, and it is also determined whether the moisture retentive liquid includes monohydric alcohol, so as to perform control. Therefore, according to the degree of dryness of the absorbent material 50, the quantity or the time interval (for the supply operation) of the supplied moisture retentive liquid can be appropriately controlled, thereby reducing useless consumption of the moisture retentive liquid as much as possible and effectively avoiding clogging of the nozzle opening 111, or the like.

Device Manufacturing Method and Electronic Device

The method of operating the droplet jetting apparatus as an embodiment of the present invention has been explained above. The droplet jetting apparatus can be used as a film forming apparatus for forming films, a wiring apparatus for forming wiring such as metal wiring, or a device manufacturing apparatus for manufacturing devices such as microlens arrays, liquid crystal devices, organic EL devices, plasma display devices, or field emission displays (FEDs).

By using the above-explained droplet jetting apparatus, droplets are jetted onto the substrate P as a work so as to form a pattern, and after that, if a predetermined period of time has elapsed without forming a pattern, the moisture retentive liquid can be supplied into the capping portion of the nozzle opening while maintaining the capped state. Therefore, it is unnecessary to move the droplet jetting head when the moisture retentive liquid is supplied. Accordingly, devices can be efficiently manufactured without reducing the throughput, thereby reducing the manufacturing cost for devices.

The above-explained devices such as liquid crystal displays, organic EL devices, plasma display devices, or FEDs are provided in electronic devices such as notebook computers or cellular phones. However, the electronic devices are not limited to the notebook computers or the cellular phones, and the above-explained devices may be applied to various kinds of electronic devices such as liquid crystal projectors, personal computers (PCs) accommodating multimedia, engineering workstations (EWSs) accommodating multimedia, pagers, word processors, televisions, video tape recorders having a viewfinder or a direct-view monitor, electronic (or personal) organizers, electronic desktop calculators, car navigation devices, POS terminals, or devices having a touch panel.

Figure 5:
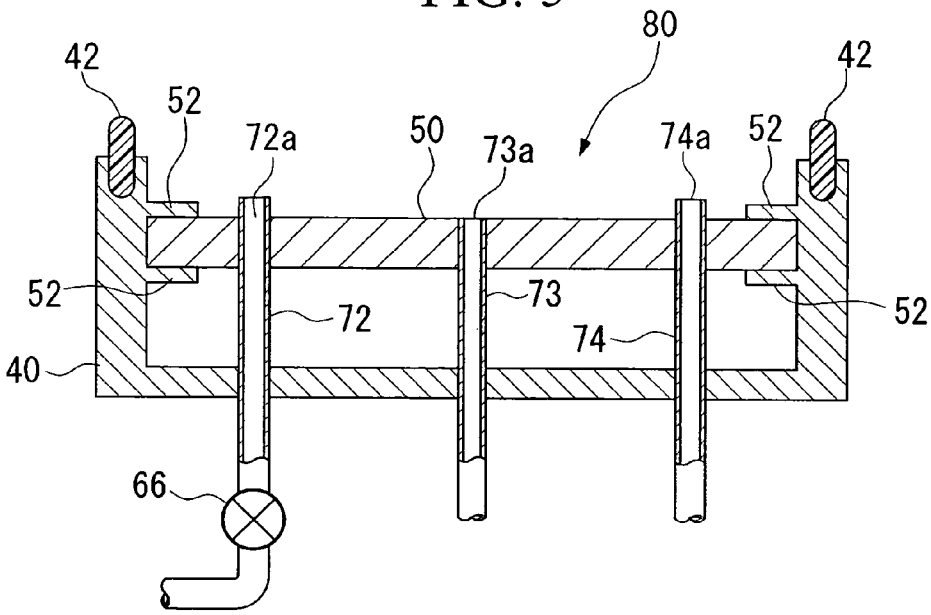
FIG. 5 is a diagram showing a main portion of the capping unit as another embodiment.

In addition, the structure of the capping device is not limited to that shown in FIG. 3, and the structure as shown in FIG. 5 is also possible.

The capping unit 80 in FIG. 5 has a first communication tube 74 connected to the first pump 46, a second communication tube 73 connected to the second pump 56, and a third communication tube 72 connected to the atmosphere open valve 66, where the three communication tubes are elongated so as to pass through the absorbent material 50, and the open ends 74*a* and 72*a* of the first communication tube 74 and the third communication tube 72 are positioned higher than the upper surface of the absorbent material 50 and also higher than the open end 73*a* of the second communication tube 73. In this structure, the position in height of the open end 73*a* equals that of the upper surface of the absorbent material 50.

According to the above structure, when the air inside the capping main body 40 is drawn by driving the first pump 46 so as to reduce the pressure of the inside, it is possible to effectively prevent the moisture retentive liquid, which is absorbed by the absorbent material 50, from being attracted from the open end 74*a* of the first communication tube 74. Therefore, a preferable moist state of the absorbent material 50 can be maintained. In addition, when the moisture retentive liquid is supplied, it is also possible to prevent the moisture retentive liquid, which is supplied via the second communication tube 73 to the capping main body 40, from escaping to the atmosphere from the open end 72*a* of the third communication tube 72, thereby reducing useless consumption of the moisture retentive liquid. Furthermore, it is possible to effectively prevent the liquid, which is deposited to the absorbent material 50, from containing air bubbles due to backflow of the air or liquid from the first communication tube 74 or due to the air drawn from the third communication tube which is open to the atmosphere. Therefore, no air bubbles are adhered to the nozzle formation surface and it is unnecessary to uselessly perform a cleaning operation.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A droplet jetting apparatus having a droplet jetting head which includes a nozzle opening from which droplets of a predetermined liquid are jetted and which is formed in a nozzle formation surface, and a capping device for capping at least the nozzle opening of the droplet jetting head, the apparatus comprising:

an absorbent material provided in the capping device, wherein the absorbent material is isolated from the nozzle formation surface; and a moisture retentive liquid supply device for supplying a moisture retentive liquid with respect to the predetermined liquid to a space formed by the nozzle formation surface and the capping portion, wherein the moisture retentive liquid supply device is connected to the capping device.

2. A droplet jetting apparatus as claimed in claim 1, wherein the moisture retentive liquid is supplied from a side opposite to a side where the droplet jetting head is provided, with respect to the absorbent material.

3. A droplet jetting apparatus as claimed in claim 2, further comprising:

a counting device for counting a period of time while the nozzle opening is capped by the capping device; and a control device for controlling supply timing of the moisture retentive liquid into the space according to the kind of the moisture retentive liquid.

4. A droplet jetting apparatus as claimed in claim 1, further comprising:

a counting device for counting a period of time while the nozzle opening is capped by the capping device; and a control device for controlling supply timing of the moisture retentive liquid into the space according to the kind of the moisture retentive liquid.

5. A droplet jetting apparatus as claimed in claim 1, wherein the moisture retentive liquid is supplied while a capped state of the nozzle opening of the droplet jetting head is maintained using the capping device.

6. A droplet jetting apparatus as claimed in claim 1, further comprising:

a suction device for performing a suction operation for reducing a pressure in the capping device, wherein in the suction operation, air is drawn from a space between the nozzle formation surface and the absorbent material.

7. A droplet jetting apparatus as claimed in claim 1, wherein:

an opening of an atmosphere communication passage for making the inside of the capping device open to the atmosphere is provided in a space between the nozzle formation surface and the absorbent material.

8. A method of operating a droplet jetting apparatus which includes a droplet jetting head which includes a nozzle opening from which droplets of a predetermined liquid are jetted and which is formed in a nozzle formation surface, a capping device for capping at least the nozzle opening of the droplet jetting head, and a moisture retentive liquid supply device for supplying a moisture retentive liquid with respect to the predetermined liquid to a space formed by the nozzle formation surface and the capping portion, wherein:

an absorbent material is provided in the capping device, and is isolated from the nozzle formation surface; and the method comprises supplying the moisture retentive liquid into the space after the nozzle opening is capped by the capping device.

9. A device manufacturing method for manufacturing a device which includes a work on which a functional pattern is formed in a predetermined area, the method comprising:

a pattern forming step performed using a droplet jetting head used in the method as claimed in claim 8, wherein the step includes forming the pattern on a work by jetting droplets of the predetermined liquid by using the droplet jetting head.

10. A method as claimed in claim 8, further comprising:

a suction step of performing a suction operation for reducing a pressure in the capping device, wherein in the suction operation, air is drawn from a space between the nozzle formation surface and the absorbent material.

11. A method as claimed in claim 8, further comprising:

a step of making the inside of the capping device open to the atmosphere via a space between the nozzle formation surface and the absorbent material.

12. A device manufacturing method for manufacturing a device which includes a work on which a functional pattern is formed in a predetermined area, the method comprising:

a pattern forming step performed using a droplet jetting head provided a droplet jetting apparatus wherein:

the droplet jetting head includes a nozzle opening from which droplets of a predetermined liquid are jetted and which is formed in a nozzle formation surface;

the droplet jetting apparatus has:

a capping device for capping at least the nozzle opening of the droplet jetting head;

an absorbent material provided in the capping device, wherein the absorbent material is isolated from the nozzle formation surface; and a moisture retentive liquid supply device for supplying a moisture retentive liquid with respect to the predetermined liquid to a space formed by the nozzle formation surface and the capping portion, wherein the moisture retentive liquid supply device is connected to the capping device;

the pattern forming step includes forming the pattern on the work by jetting droplets of the predetermined liquid by using the droplet jetting head; and the method further comprises:

a step of supplying the moisture retentive liquid into the space after the nozzle opening is capped by the capping device.

* * * * *